US009945281B2

(12) United States Patent
Pitcel et al.

(10) Patent No.: US 9,945,281 B2
(45) Date of Patent: Apr. 17, 2018

(54) COOLING SYSTEM FOR AIR-COOLED ENGINES

(71) Applicant: Briggs & Stratton Corporation, Wauwatosa, WI (US)

(72) Inventors: Michael Pitcel, Waukesha, WI (US); David Procknow, Elm Grove, WI (US); Jacob Zuehl, Hartland, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 159 days.

(21) Appl. No.: 14/970,351

(22) Filed: Dec. 15, 2015

(65) Prior Publication Data

US 2017/0167353 A1 Jun. 15, 2017

(51) Int. Cl.
*F01P 7/02* (2006.01)
*F01P 1/02* (2006.01)
(Continued)

(52) U.S. Cl.
CPC ..... *F01P 1/02* (2013.01); *F01P 1/06* (2013.01); *F01P 5/04* (2013.01); *F01P 5/06* (2013.01); *F01P 7/048* (2013.01); *F01P 7/08* (2013.01); *F01P 11/08* (2013.01); *F01P 5/02* (2013.01); *F01P 7/02* (2013.01); *F01P 11/10* (2013.01); *F01P 2001/026* (2013.01); *F01P 2005/046* (2013.01); *F01P 2025/13* (2013.01); *F01P 2025/31* (2013.01); *F01P 2025/33* (2013.01); *F01P 2025/40* (2013.01); *F01P 2025/64* (2013.01); *F01P 2037/00* (2013.01); *F04D 29/54* (2013.01)

(58) Field of Classification Search
CPC ..... F01P 7/02; F01P 5/06; F01P 11/10; F01P 5/02; F01P 1/02; F04D 29/54
USPC ..... 123/41.12
See application file for complete search history.

(56) References Cited

U.S. PATENT DOCUMENTS 4,156,409 A 5/1979 Nakano
4,841,920 A 6/1989 Andreasson et al.
(Continued)

FOREIGN PATENT DOCUMENTS

WO WO-2011/068446 A1 6/2011

OTHER PUBLICATIONS

YouTube Video, Toro® Groundsmaster® 5900, retrieved on Jul. 12, 2016 from https://www.youtube.com/watch?v=KWUv9Yy4qpw ("uploaded" Jul. 30, 2009).
(Continued)

*Primary Examiner* — Jacob Amick
*Assistant Examiner* — Charles Brauch
(74) *Attorney, Agent, or Firm* — Foley & Lardner LLP

(57) ABSTRACT

A cooling system for an air-cooled engine includes a plurality of electric fans, a plurality of ducts, each duct configured to receive one of the plurality of electric fans, a housing, the housing configured to be coupled to the engine and to include at least one opening, each opening is configured to be coupled to receive one of the plurality of ducts to direct air from the electric fans to a plurality of target locations, a sensor, the sensor is configured to acquire sensor data regarding the operation of the engine, and a processing circuit, the processing circuit is configured to receive the sensor data from the sensor and to control operation of the plurality of electric fans in accordance with the sensor data.

18 Claims, 11 Drawing Sheets

(51) Int. Cl.

| | |
|---|---|
| ***F01P 1/06*** | (2006.01) |
| ***F01P 5/04*** | (2006.01) |
| ***F01P 5/06*** | (2006.01) |
| ***F01P 11/08*** | (2006.01) |
| ***F01P 7/04*** | (2006.01) |
| ***F01P 7/08*** | (2006.01) |
| *F04D 29/54* | (2006.01) |
| *F01P 5/02* | (2006.01) |
| *F01P 11/10* | (2006.01) |

(56) References Cited

U.S. PATENT DOCUMENTS

| | | | | |
|---|---|---|---|---|
| 5,542,380 | A | 8/1996 | Chatten | |
| 7,069,896 | B2 | 7/2006 | Tsunoda et al. | |
| 7,201,132 | B2 | 4/2007 | Miyake et al. | |
| 7,225,765 | B2 | 6/2007 | Leech et al. | |
| 7,363,885 | B2 | 4/2008 | Miyake et al. | |
| 7,409,931 | B2 | 8/2008 | Kochi et al. | |
| 7,412,961 | B2 | 8/2008 | Doring | |
| 7,475,657 | B2 | 1/2009 | Dopke et al. | |
| 7,950,355 | B2 | 5/2011 | Nakamizo | |
| 7,958,855 | B2 | 6/2011 | Nakamizo | |
| 8,241,378 | B2 | 8/2012 | Sullivan et al. | |
| 8,424,498 | B2 | 4/2013 | Tiefenthaler et al. | |
| 8,720,392 | B2 | 5/2014 | Tiefenthaler et al. | |
| 8,746,186 | B2 | 6/2014 | Sullivan et al. | |
| 2003/0236595 | A1* | 12/2003 | Frankel | G05D 23/1917 700/300 |
| 2004/0025827 | A1 | 2/2004 | Davis | |
| 2012/0330496 | A1* | 12/2012 | Eser | F01P 11/16 701/30.8 |
| 2014/0261259 | A1* | 9/2014 | Sullivan | F01P 5/02 123/41.65 |

OTHER PUBLICATIONS

Internet Video, Toro® Groundsmaster® Smart Cool™ System, retrieved on Jul. 12, 2016 from http://commercialvideo.toro.com/watch/SaOMAmmcF7JS2Lvp4VeWvg ("uploaded" Jun. 9, 2015).

Briggs & Stratton, Commercial Turf Series, Operator's Manual, 2013, 32 pages.

Briggs & Stratton, Vanguard, Operator's Manual, 2012, 28 pages.

US Office Action, U.S. Appl. No. 14/035,469, 12 pages (dated Nov. 17, 2015).

* cited by examiner

COOLING SYSTEM FOR AIR-COOLED ENGINES

BACKGROUND

The present disclosure generally relates to an electric cooling fan system for an air-cooled engine suitable for use with outdoor power equipment, such as lawn mowers, riding tractors, snow throwers, pressure washers, portable generators, tillers, log splitters, zero-turn radius mowers, walk-behind mowers, riding mowers, industrial vehicles such as forklifts, utility vehicles, etc. Outdoor power equipment may, for example, use an internal combustion engine to drive an implement, such as a rotary blade of a lawn mower, a pump of a pressure washer, the auger of a snow thrower, the alternator of a generator, and/or a drivetrain of the outdoor power equipment. More specifically, the present invention relates to an electric cooling fan system for an air-cooled engine suitable for use with a standby generator. Standby generators are utilized in a variety of applications including commercial, residential, municipal, and emergency applications.

SUMMARY

One embodiment of the present disclosure relates to a cooling system for an air-cooled engine including multiple electric fans, multiple ducts, a housing, a sensor, and a processing circuit. Each duct is configured to receive one of the electric fans. The housing is configured to be coupled to the engine and to include at least one opening. Each opening is configured to receive one of the ducts to direct air from the electric fans to a plurality of target locations. The sensor is configured to acquire sensor data regarding operation of the engine. The processing circuit is configured to receive the sensor data from the sensor and to control operation of the plurality of electric fans in accordance with the sensor data.

Another embodiment of the present disclosure relates to a cooling system for an air-cooled engine including an electric fan, a shroud assembly, a sensor, and a processing circuit. The sensor is configured to acquire sensor data regarding operation of the engine. The processing circuit is configured to receive the sensor data from the sensor to determine a cooling need for the engine and to vary the cooling output of the electric fan in accordance with the cooling need.

Yet another embodiment of the present disclosure relates to a control system for an engine cooling system including a sensor and a processing circuit. The sensor is configured to acquire sensor data regarding operation of an engine. The processing circuit is configured to receive the sensor data, determine a cooling need of the engine based on the sensor data, and control operation of at least one electric fan independent from an operating speed of the engine and based on the cooling need of the engine. The processing circuit may be at least one of a general-purpose processor and non-programmable circuitry. The processing circuit may compare the sensor data to a threshold to determine the cooling need of the engine. The processing circuit may be configured to modulate the output of the electric fan according to a modulation scheme and wherein the modulation scheme is one of pulse-width modulation and pulse-duration modulation.

It is to be understood that both the foregoing general description and the following detailed description are exemplary and explanatory only, and are not restrictive of the invention as claimed.

DETAILED DESCRIPTION

Figure 1:
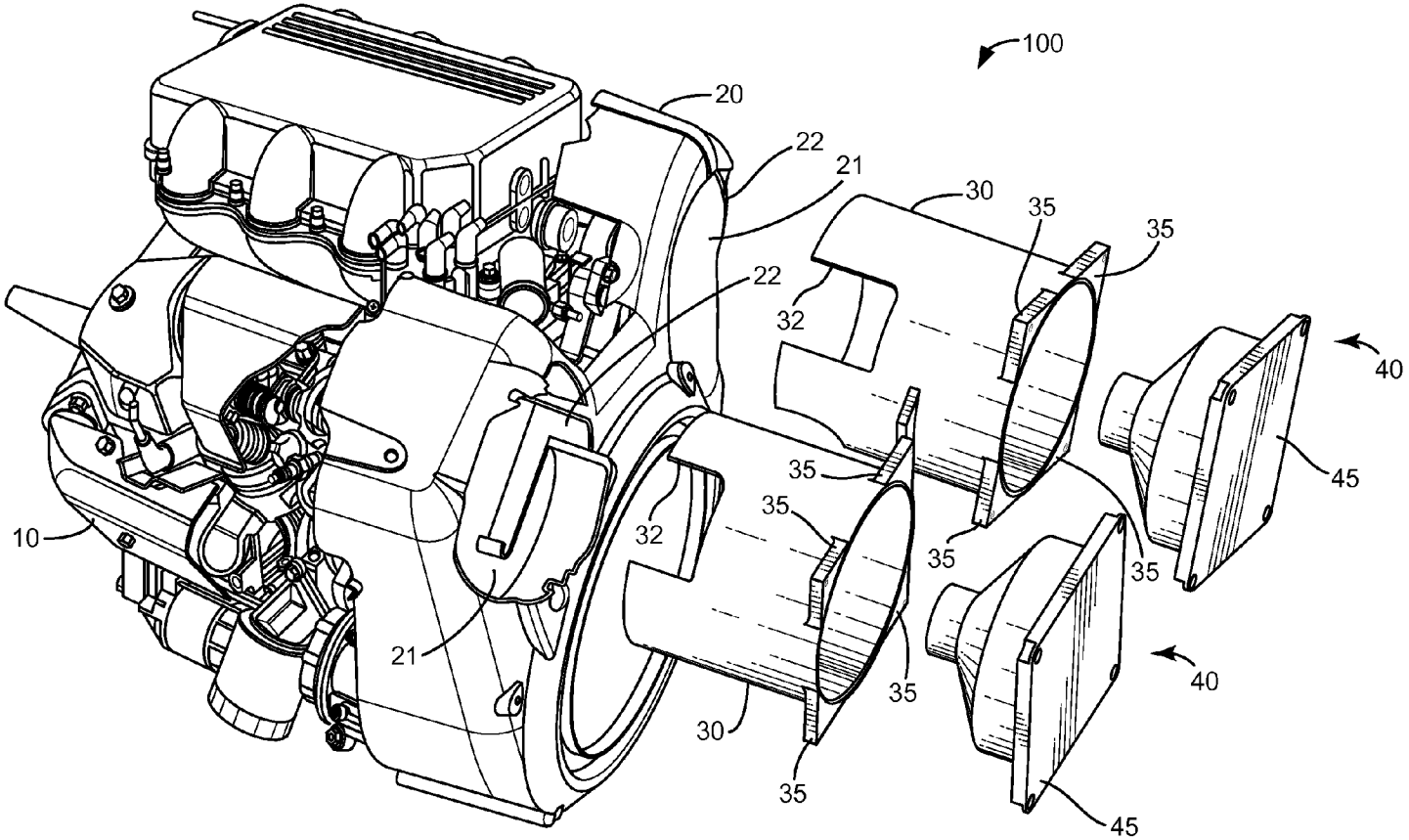
FIG. 1 is a partially exploded perspective view of an engine cooling system for an engine including an internal combustion engine, a housing, ducts, and electric fans, according to an exemplary embodiment of the present disclosure.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Standby generators typically include internal combustion engines. Internal combustion (IC) engines can operate using a variety of different fuel sources including liquid propane (LP), natural gas, gasoline, diesel, mixtures of fuels, and many other fuel sources. In general, standby generators are connected to an application site and to a surrounding power grid. In the event of a loss of electrical power from the surrounding power grid, a standby generator is designed to turn on and provide a certain amount of electrical power to the application site. In application, the standby generators often do not instantaneously operate once electrical power is lost. Rather, a certain amount of time passes before the standby generators are "warmed up" and ready to provide electrical power to the application site. During operation, standby generators typically may consume large amounts of fuel, produce undesirable noise, and/or dissipate heat energy. Once electrical power originating from the power grid is restored, a standby generator may shut down. After shutting down, the standby generator may require a certain amount of time to "cool down." In order to be prepared for power outages, standby generators typically run through a routine "exercise cycle" multiple times throughout the life of the standby generator. For certain generators, these exercise cycles can occur as often as multiple times per week. It is during these exercise cycles that individuals often become aware of the noise, fuel, and other implications involved with owning and maintaining a standby generator. A common complaint of standby generators is that they produce excessive noise and are a "nuisance" when not needed.

Standby generators are utilized in a wide array of applications. In residential applications, standby generators are commonly referred to as home standby (HSBs) generators. An HSB generator is typically installed outside a home and can be sized to accommodate a variety of different electrical demands. Larger homes may, for instance, require a large HSB generator to power multiple rooms, electronic devices, and other devices such as water pumps, refrigerators, a central heating and/or cooling system, and many other devices. Smaller homes may utilize an HSB generator sized only to meet the electrical demand of critical devices, such as a water pump and a central heating system. For businesses and other large scale electrical demands, commercial standby generators may be installed in almost any application. Typically, commercial standby generators are present at sporting events, such as the Super Bowl, hospitals, retail stores and malls, transit stations, airports, and many more installations. Commercial standby generators are typically much larger than HSB generators.

Standby generators may be divided into two categories: liquid-cooled standby generators and air-cooled standby generators. Air-cooled standby generators utilize fans to force air across the engine for cooling. Liquid-cooled standby generators use enclosed radiator systems for cooling in a method similar to that commonly used in the automotive industry. Typically, liquid-cooled engines are quieter than air-cooled engines. While most HSB generators are air-cooled, most commercial standby generators are liquid-cooled. However, some HSB generators are so large that they require liquid-cooled engines. In general, the liquid-cooled standby generators produce greater power output than their air-cooled counterparts.

HSB generators typically receive more complaints regarding noise level than commercial standby generators, in large part due to their typically air-cooled design. A typical HSB generator may perform routine exercise cycles as often as once per week. Air-cooled generators typically incorporate a fan (e.g., a blower) mechanically coupled to a crankshaft. Typically, the fan is mechanically coupled to the crankshaft by mounting to a flywheel. Inherently, these fans run constantly during generator use and have a speed directly tied to the speed of the engine. These fans typically provide centrifugal or radial air flow to the engine. While the incorporation of a fan may not only be inefficient in terms of cooling the internal engine, it also may account for additional consumption of available engine output. As such, various embodiments disclosed herein relate to an alternative to conventional crankshaft mounted fan designs wherein the speed of the fan, and therefore the energy consumption of the fan, is not necessarily tied to the speed of the internal combustion engine.

Referring to FIGS. 1-4, in one embodiment, an engine cooling system 100 includes a housing 20, a number of ducts 30, and a number of electric fans 40 typically corresponding to the number of ducts. An internal combustion (IC) engine 10 may include a crankshaft. According to various exemplary embodiments, the electrical fans 40 are not mechanically coupled to the crankshaft of the internal combustion engine 10. According to an exemplary embodiment, the electric fans 40 may provide air flow directly to a target location, through the ducts 30, which are coupled to the housing 20. Housing 20 is coupled to the internal combustion engine 10, to assist in cooling of the internal combustion engine 10. According to various embodiments, the target location may be a cylinder, cylinder heads, an oil cooler, and/or an alternator of the internal combustion engine 10.

Engine cooling system 100 may be utilized with a variety of air-cooled engine applications. For example, engine cooling system 100 may be utilized in a standby generator or outdoor power equipment. Outdoor power equipment includes lawn mowers, riding tractors, snow throwers, pressure washers, portable generators (e.g., portable genset, etc.), tillers, log splitters, zero-turn radius (ZTR) mowers, walk-behind mowers, riding mowers, industrial vehicles such as forklifts, utility vehicles, etc. Outdoor power equipment may, for example, drive an implement, such as a rotary blade of a lawn mower, a pump of a pressure washer, the auger of a snowthrower, the alternator of a generator, and/or a drivetrain of the outdoor power equipment.

According to alternative embodiments, the engine cooling system 100 may incorporate a number of additional electric fans 40 individually placed on a number of individual target locations. Each additional electric fans 40 may be individually coupled to a duct 30 positioned (e.g., via a mounting bracket, etc.) such that the electrical fan provides air to the desired target location. For example, the engine cooling system 100 may include an additional electric fan mounted to provide direct airflow to the oil cooler. In another example, the engine cooling system 100 may include an additional electric fan mounted to provide direct airflow to the alternator. According to various embodiments, the directional cooling facilitated by the engine cooling system 100 may reduce the overall cooling airflow requirements of the system.

The electric fans 40 may be configured to be electrically coupled to a charging system (e.g., the alternator) of the internal combustion engine 10. According to one embodiment, the electric fans 40 have an input voltage of 12 Volts (V) direct-current (DC), a diameter of approximately 142.24 millimeters (5.6 inches), and a current draw of between 2.5-3.4 Amperes (A). According to some embodiments, the 12V input voltage of the electric fans 40 is intended to be close to the operating voltage of typical standby generators. According to another embodiment, the electric fans 40 may be configured to be powered off of 120V alternating current (AC) from the application site in order to operate in the most desirable manner. In some applications, the engine cooling system 100 may receive power directly from the standby generator. In these applications, it may be advantageous to power the electric fans 40 off of 120V AC power which is commonly output by standby generators. According to one embodiment, the electric fans 40 may be the VA21A3745A electric fan produced by SPAL Automotive.

The electric fans 40 may be securely mounted into ducts 30 through various fastening mechanisms such as a friction fit, the use of interlocking tabs and/or notches, a snap fit, the use of fasteners, the use of adhesive-based products, through the implementation and interlocking of a thread pattern on the electric fan and the duct 30, and other suitable fastening mechanisms. The housing 20 is configured to receive the ducts 30. The ducts 30 may be securely mounted into the housing 20 through various fastening mechanisms such as, a friction fit, the use of tabs and/or notches, a snap fit, the use of fasteners, the use of adhesive-based products, through the implementation and interlocking of a thread pattern on the duct 30 and the housing 20, and other suitable fastening mechanisms. The internal combustion engine 10 is configured to include a mechanism for securely mounting the housing 20 to the internal combustion engine 10. The housing 20 may be securely mounted to the internal combustion engine 10 through various fastening mechanisms such as, a friction fit, the use of tabs and/or notches, a snap fit, the use of fasteners, the use of adhesive-based products, and other suitable fastening mechanisms.

The housing 20 is configured to include a number of openings 21 configured to accept a corresponding number of ducts 30. In various embodiments, the housing 20 may be configured to be attached to a standard V-twin engine 10. In these embodiments, the housing 20 may include two openings 21, with each opening 21 positioned over a cylinder of the V-twin engine 10. In some of these embodiments, the housing 20 includes two openings 20 with each positioned substantially over a cylinder head of the V-twin engine 10.

Figure 2:
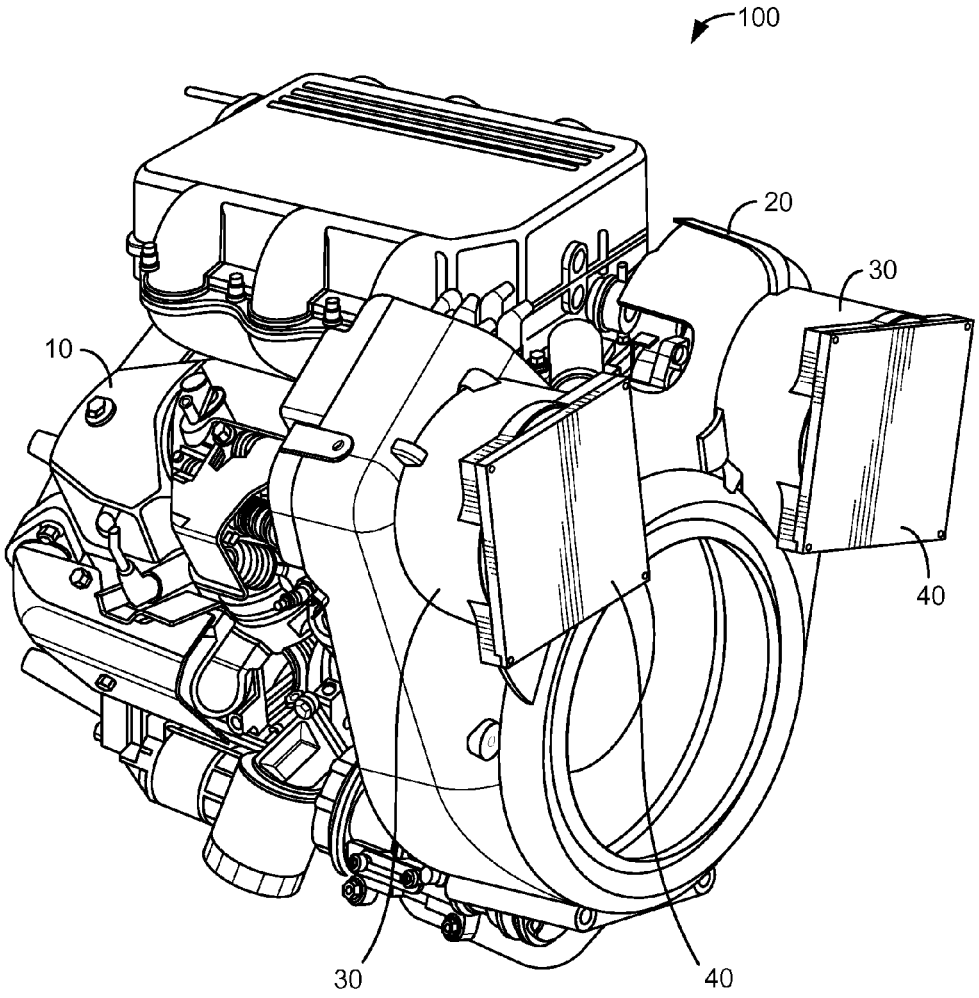
FIG. 2 is a perspective view of the engine cooling system for an engine shown in FIG. 1, according to an exemplary embodiment of the present disclosure.

Referring further to FIGS. 1-2, the ducts 30 may be configured to be substantially cylindrical with one circular end including a number of flanges 35. The flanges 35 may be configured to be mounting surfaces of the electric fan 40. According to one embodiment, the flanges 35 are substantially triangular shaped and include a number of holes, each disposed at a corner of the triangle. According to this embodiment, the electric fan 40, which may have a square shaped mounting face 45 containing a number of holes correspondingly disposed at each corner of the square, may be mounted to the flange 35 through the insertion of a number of fasteners into each of the aligned hole sets. The ducts 30 may be sized to couple with any housing 20 and electric fan 40 configuration. According to the exemplary embodiment shown in FIG. 1, the housing 20 includes a number of retaining features 22 and the ducts 30 include a number of retaining features 32. According to various exemplary embodiments, the retaining features 22 of the housing 20 are configured to interact with the retaining features 32 of the ducts 30. The retaining features 22 of the housing 20 may be tabs, hooks, posts, or other suitable retaining mechanisms. The retaining features 32 of the ducts 30 may be tabs, hooks, posts, or other suitable retaining mechanisms. According to an exemplary embodiment, the retaining features 22 of the housing 20 may be a plurality of mounting brackets which allow the electric fan duct 30 to be secured to the housing 20.

According to various embodiments, the ducts 30 are configured with a length such that, when fully installed into the housing 20, only the flanges 35 protrude from the housing 20. According to alternative embodiments, the ducts 30 may be configured with a length such that, when fully installed into the housing 20, the ducts 30 protrude a certain amount from the housing 20. The inner surface of the ducts 30 may be substantially smooth to facilitate air flow through the ducts 30.

During routine exercise cycles, standby generators typically run under no load and at maximum speed. These operating conditions cause the fan to "overcool" the engine 10. Under an overcooled condition, the oil within the standby generator may not reach an optimal operating temperature. Overcooling may also lead to water being present within the oil system. In order to insure that water is not present in the oil system, oil temperatures may be elevated to at least approximately 93 degrees Celsius (200 degrees Fahrenheit). As a result, the electric cooling fan system may be turned on, for example, at a temperature of between approximately 93 degrees Celsius (200 degrees Fahrenheit) and 100 degrees Celsius (212 degrees Fahrenheit), which will evaporate most, if not all, condensed water in the oil system. By utilizing the engine cooling system 100, the temperature of the internal combustion engine 10 may be controlled precisely. Due to their ability to be operated independent from engine speed, electric fans 40 may have a longer service life than typical fans mechanically coupled to the crankshaft of an internal combustion engine. The ability to operate at a speed independent from engine speed may allow electric fans 40 to eliminate overcooling by running at lower speeds during exercise cycles in order to facilitate optimal oil temperatures and to reduce water presence in the oil system. Further, electric fans 40 may produce less noise pollution than typical fans that are mechanically coupled to the crankshaft of an engine 10. The reduction in noise pollution is due, in part, to the relatively smaller sized blades of the electric fans 40 as well as the ability to operate the electric fans 40 at speeds independent of engine speed.

Electric fans 40 typically consume less energy than fans mechanically coupled to the crankshaft of an engine. This increase in energy efficiency is typically due to the ability of the electric fans 40 to operate at a speed independent of engine speed. Typically, electric fan blade design allows for greater efficiency over the fan assembly traditionally used in standby generators. In application, electric fans 40 may consume approximately half as much energy as traditional fans mechanically coupled to the crankshaft of an engine. A substantial portion of the energy consumed by a traditional fan assembly is through the constant rotation of the fan, regardless of cooling need. For example, a fan mechanically coupled to the crankshaft of an engine 10 may consume 1.5-1.75 horsepower (HP) while a comparable engine cooling system 100 may consume approximately 0.75-0.88 HP. According to various embodiments, the electric fans 40 may include motors, which may be brushless permanent magnet DC motors, DC motors, AC motors, direct-drive motors (e.g., motors that do not include any reduction, such as that coming from a belt or transmission, etc.), or other high efficiency motors. By utilizing the engine cooling system 100, engines and their applications, such as standby generators, may achieve a higher rated horsepower. Furthermore, by removing the need for a traditional fan being mounted to the crankshaft through the flywheel, additional engine configurations may be possible that are advantageous compared to traditional engine configurations.

During operation, it may not be desirable for the fan in the standby generator to be running at all times and at a non-variable speed, as is the case with fans that are mechanically coupled to the crankshaft of an engine. Through the use of the engine cooling system 100, the fan speed may be varied according to various parameters observed by a processing circuit. According to various embodiments, the electric fan speed may be continuously varied to achieve a desired cooling rate or other parameter of the electric cooling system. According to other embodiments, the electric fan speed may be modulated (e.g., power to the electric fan may be turned on, and then turned off) in order to achieve a desired cooling rate or other parameter of the electric cooling system. For example, the electric fan may be pulse-width modulated (PWM) or pulse-duration modulated (PDM) in order to achieve the desired parameter of the electric cooling system. Further, the processing circuit may instruct the engine cooling system 100 to modulate fan speed according to data obtained from various sensors in order to maintain or establish a certain engine temperature or other operating parameter.

Traditionally, alternator speed is directly related to engine speed. In operation, alternators have a tendency to generate a large amount of heat energy, particularly in standby generators where alternators are often larger than in typical internal combustion engine applications. In typical standby generators, alternators include a fan mounted to the alternator shaft. In certain applications, the alternator shaft may be the crankshaft of the engine. However, in other applications, such as those that utilize a belt system (e.g., a serpentine belt, etc.), the alternator may have a separate alternator shaft that is configured to be driven by the belt system. Due to the direct relationship between the engine speed and the speed of the alternator shaft, the cooling rate of the alternator may not be best matched to the cooling needs of the alternator. Through the use of the engine cooling system 100, the alternator may be directly provided air flow more closely matched to the cooling needs of the alternator.

Figure 3:
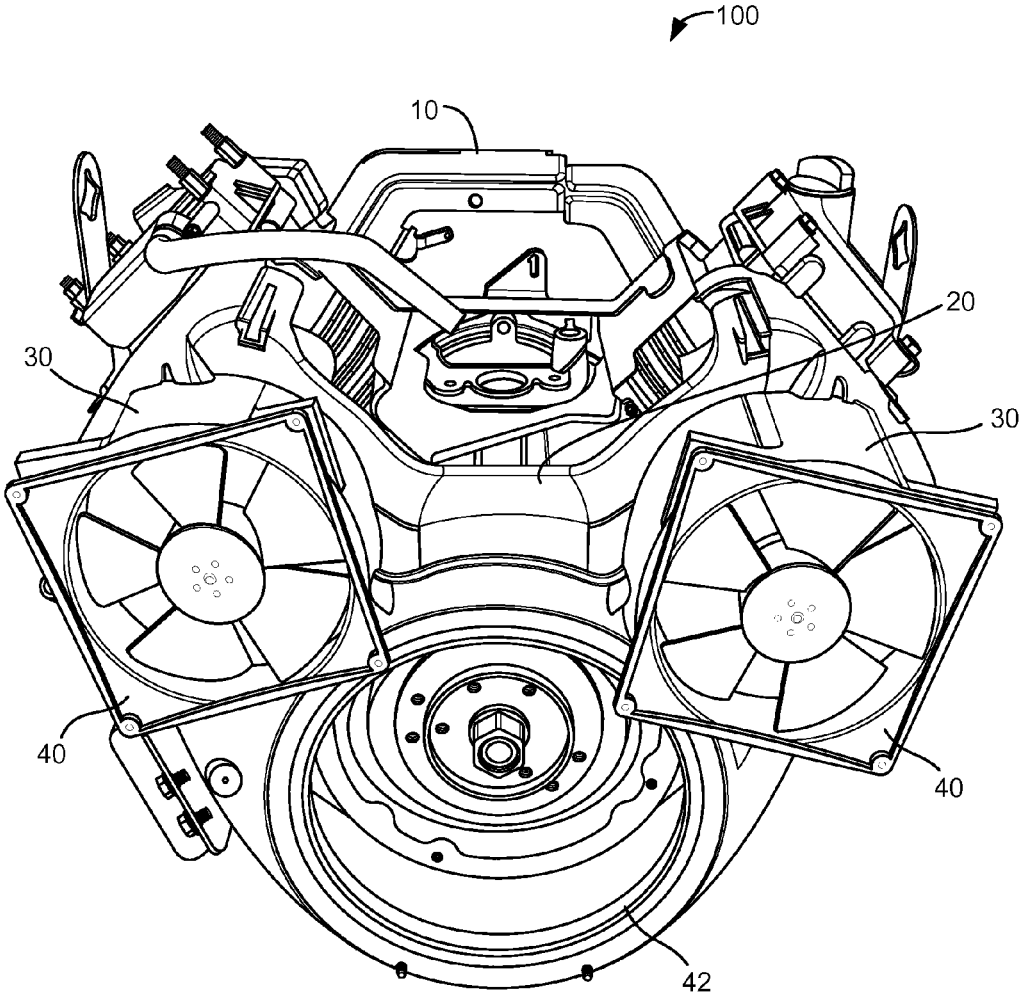
FIG. 3 is another perspective view of the engine cooling system for an engine shown in FIG. 1, according to an exemplary embodiment of the present disclosure.
Figure 4:
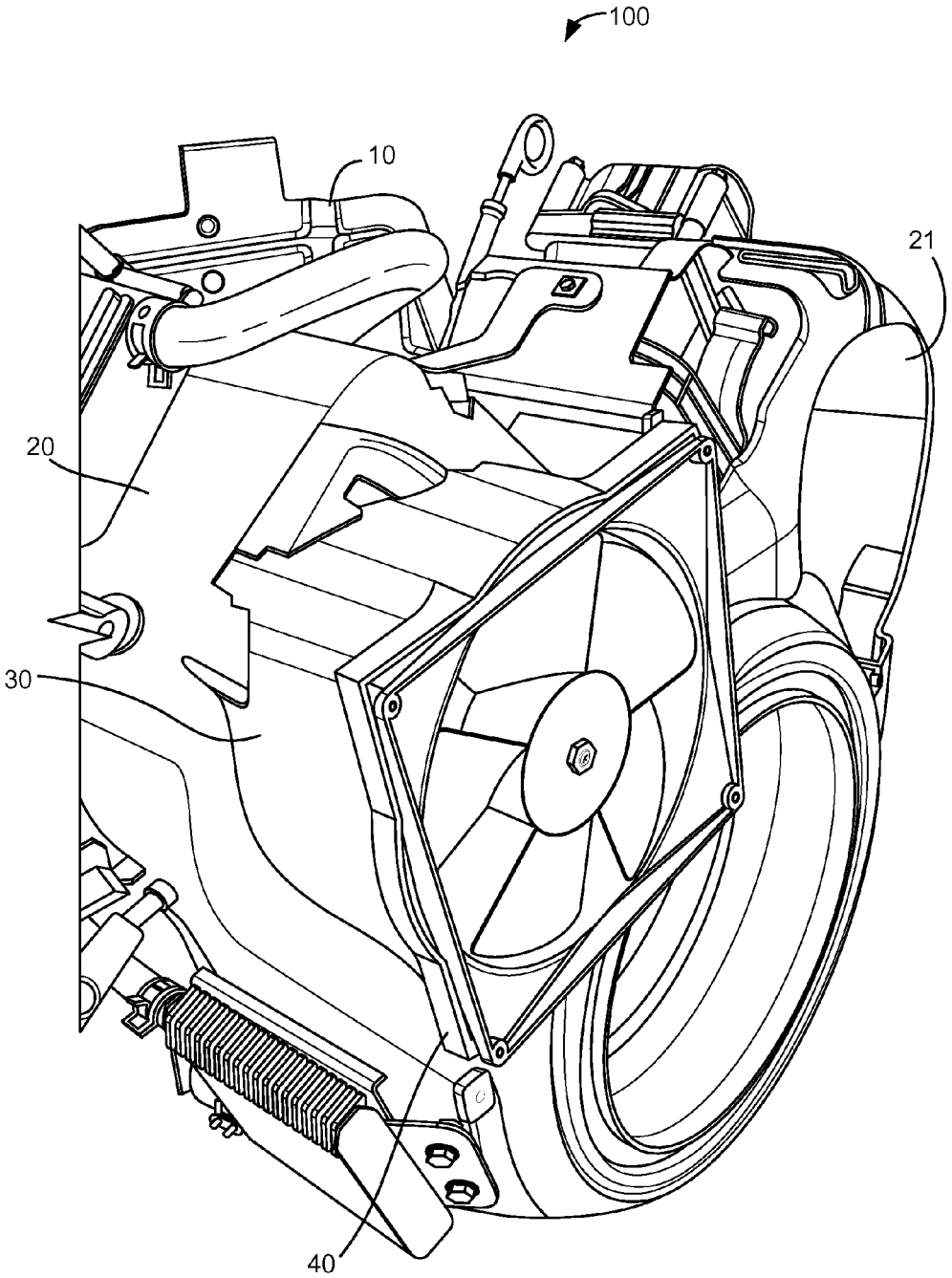
FIG. 4 is another perspective view of the engine cooling system for an engine shown in FIG. 1 wherein one of the electric fans has been removed, according to an exemplary embodiment of the present disclosure.
Figure 5:
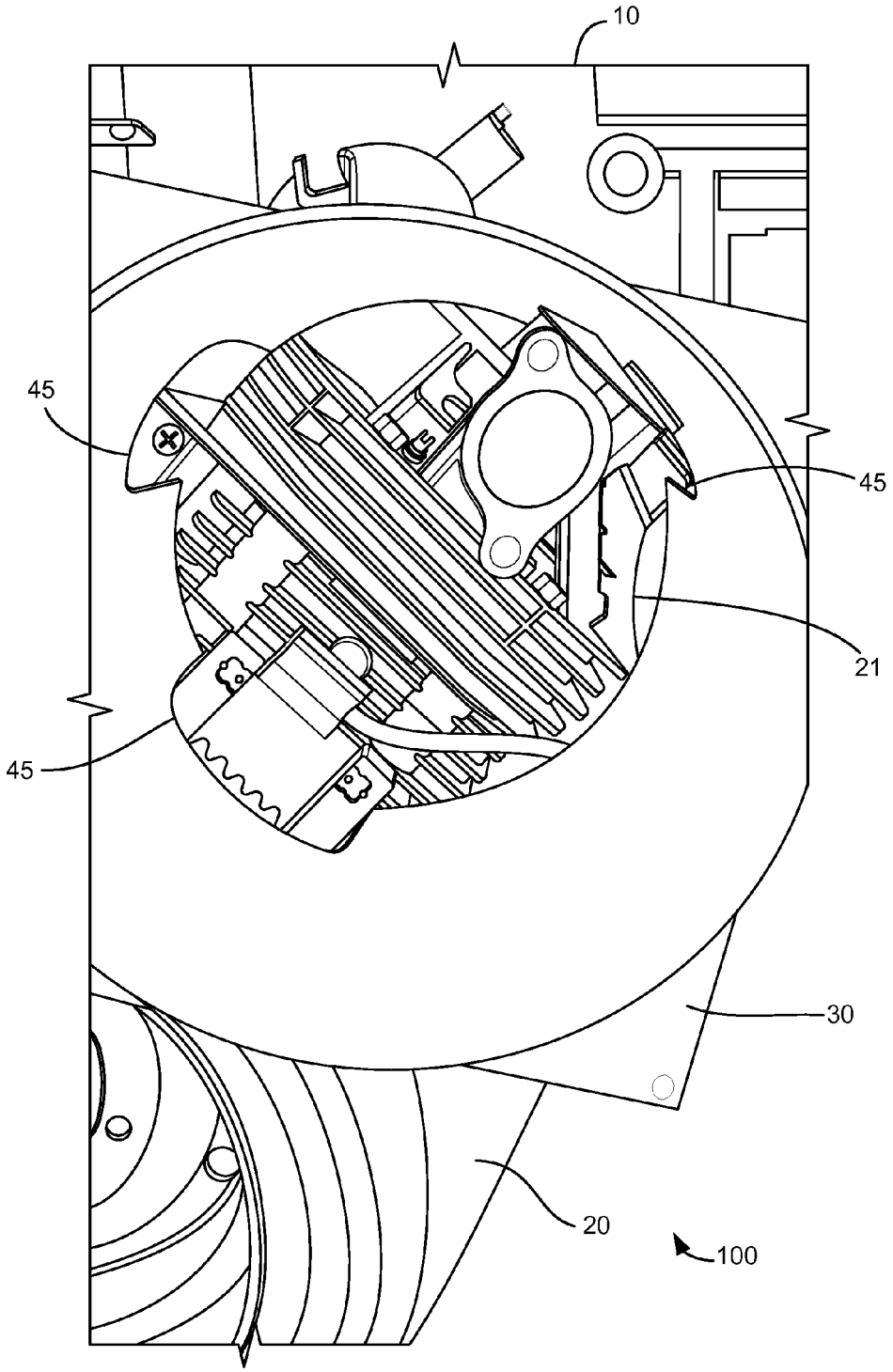
FIG. 5 is another perspective view of the engine cooling system for an engine shown in FIG. 1 wherein one of the electric fans has been removed to expose the cylinder head, according to an exemplary embodiment of the present disclosure.
Figure 6:
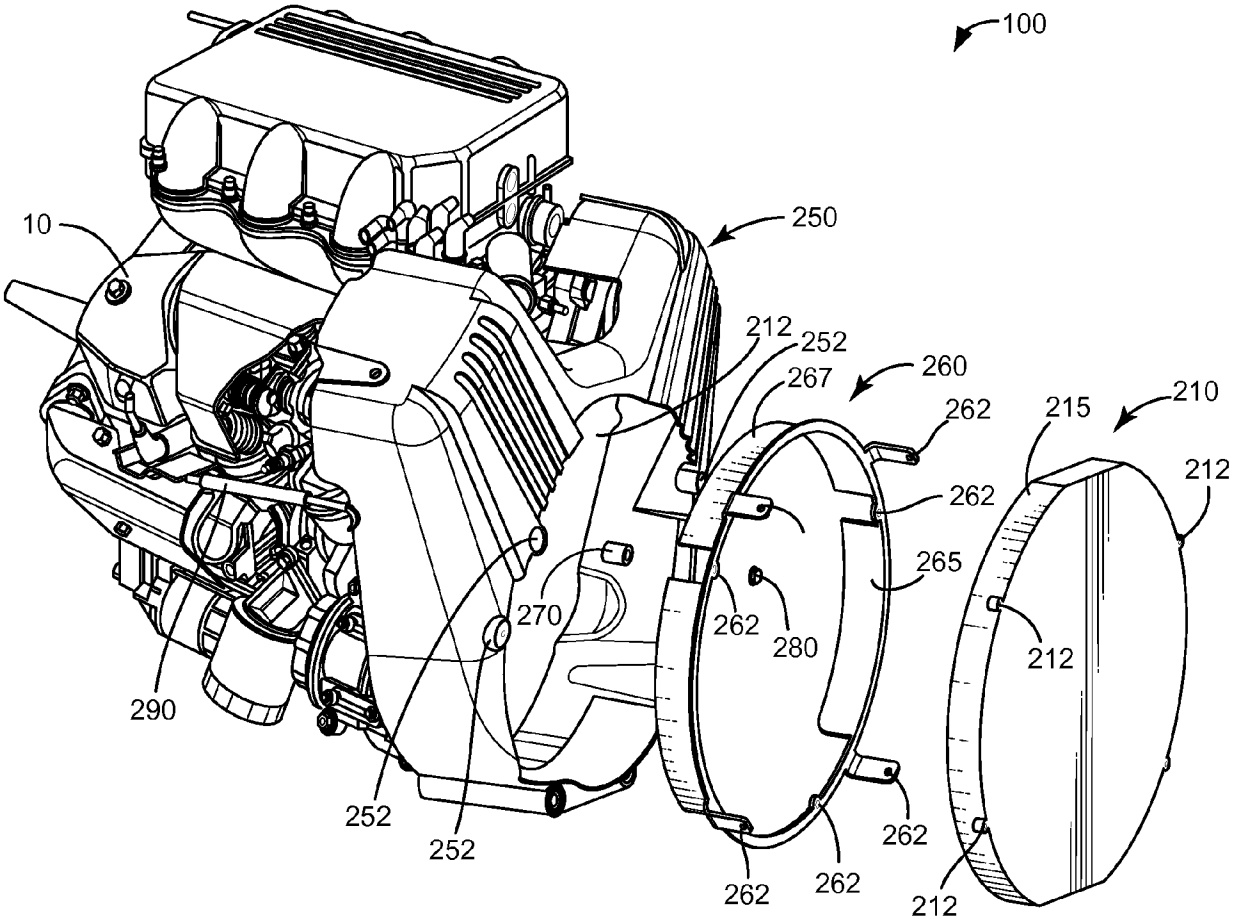
FIG. 6 is a partially exploded perspective view of another engine cooling system for an engine including an internal combustion engine, a first shroud, a second shroud, and an electric fan, according to an exemplary embodiment of the present disclosure.
Figure 7:
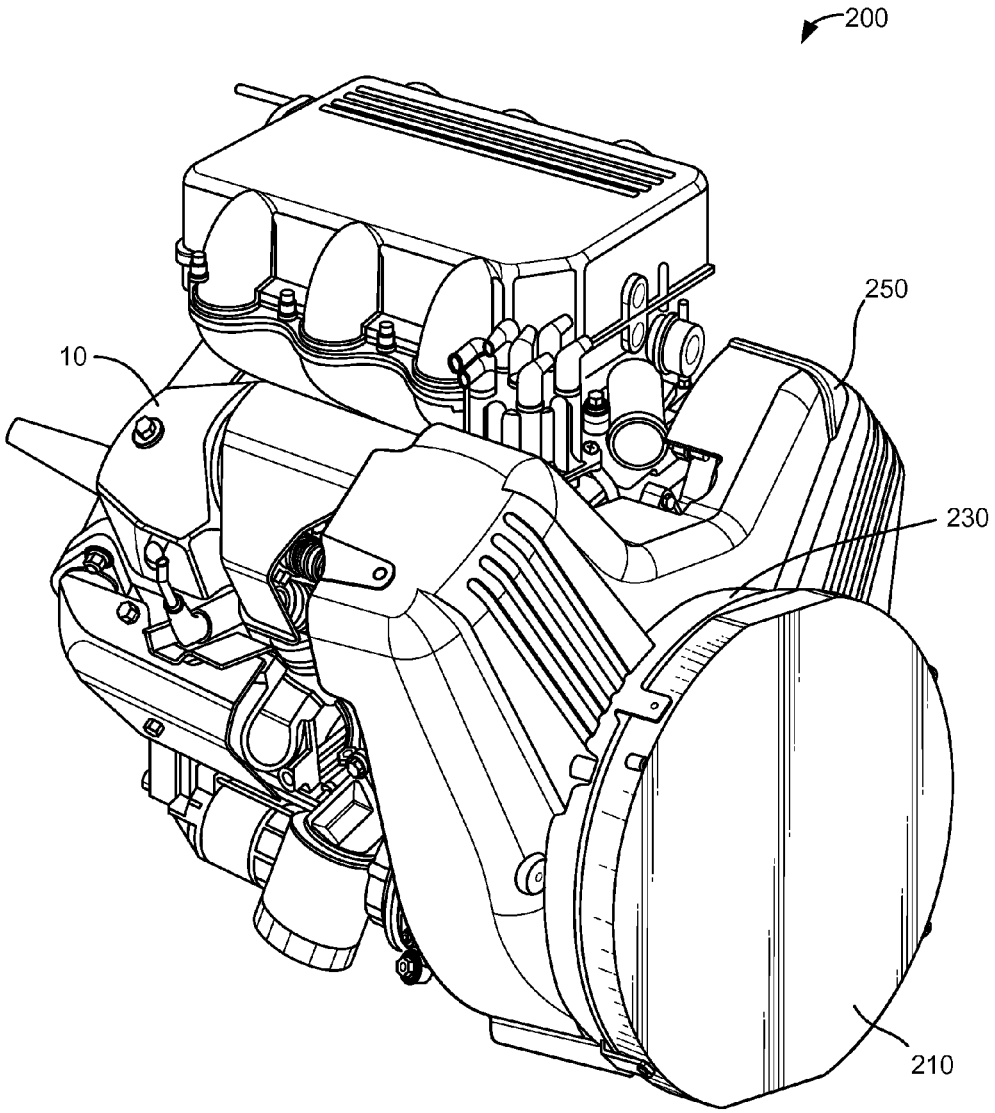
FIG. 7 is a perspective view of the engine cooling system for an engine shown in FIG. 6, according to an exemplary embodiment of the present disclosure.
Figure 8:
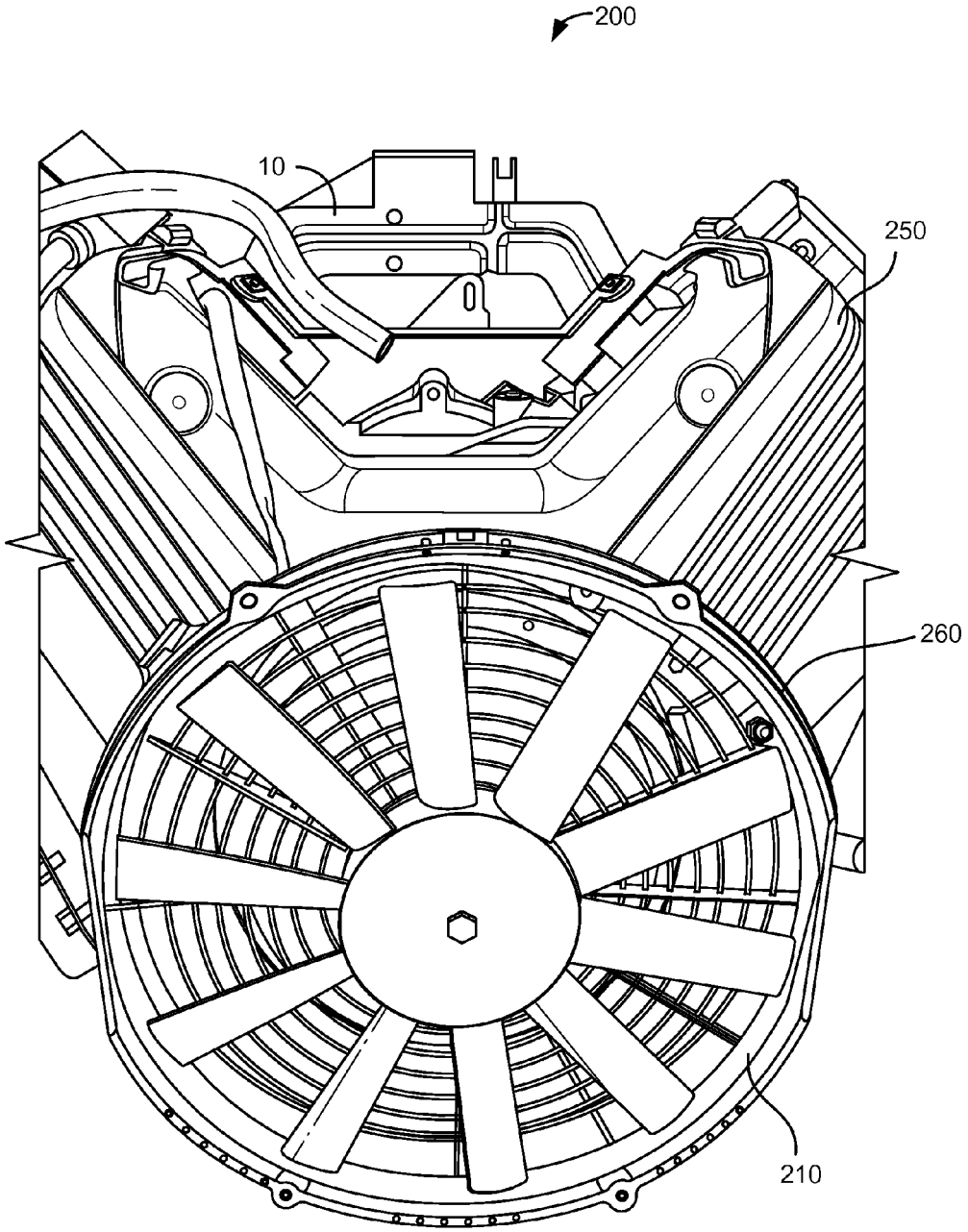
FIG. 8 is another perspective view of the engine cooling system for an engine shown in FIG. 6, according to an exemplary embodiment of the present disclosure.
Figure 9:
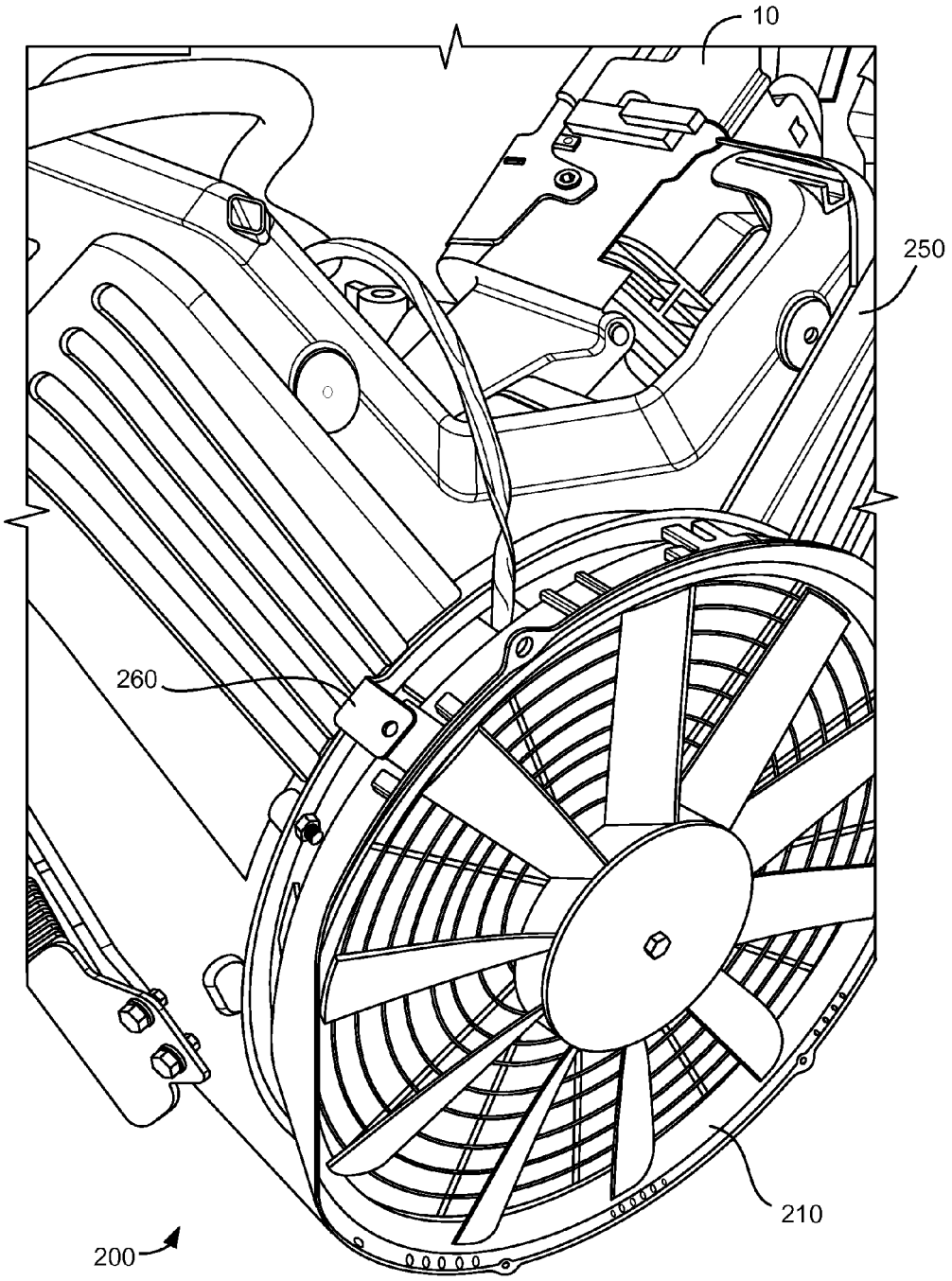
FIG. 9 is another perspective view of the engine cooling system for an engine shown in FIG. 6, according to an exemplary embodiment of the present disclosure.
Figure 10:
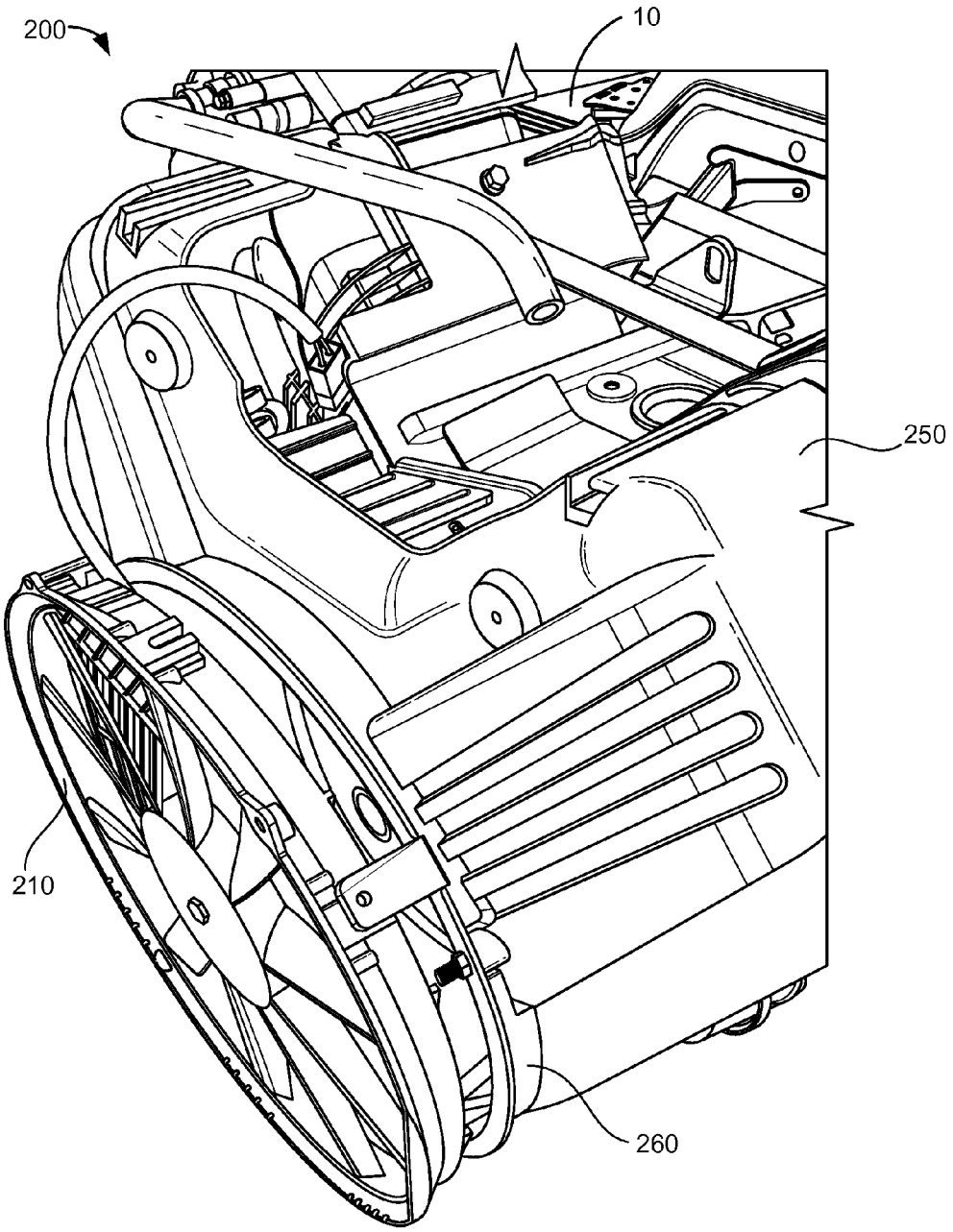
FIG. 10 is another perspective view of the engine cooling system for an engine shown in FIG. 6, according to an exemplary embodiment of the present disclosure.

Referring now to FIGS. 3-5, various illustrations are shown of engine cooling system 100 mounted to IC engine 10. Referring specifically to FIG. 3, the engine cooling system 100 is shown to include two electric fans 40, each individually mounted within the ducts 30, where the ducts 30 are both mounted within the housing 20, which is further mounted to the IC engine 10. According to an exemplary embodiment, each electric fan 40 is positioned over a cylinder of the IC engine 10. According to other embodiments, housing 20 may be configured to allow the electric fans 40 to be positioned in other locations. In various embodiments, housing 20 may have a central hole 42. Central hole 42 may be of any suitable diameter for a given application. Central hole 42 is intended to provide access to an output shaft of the IC engine 10.

Referring specifically to FIG. 4, the engine cooling system 100 is shown to include one electric fan 40 mounted with the duct 30, where the duct 30 is mounted within housing 20. According to the exemplary embodiment illustrated in FIG. 4, the engine cooling system 100 may only contain one electric fan 40, rather than two an illustrated in, for example, FIG. 3. In certain applications, a user may desire cooling only on one cylinder of the IC engine 10. According to various embodiments, a user may desire different variations of the electric fan 40 be included in the engine cooling system 100. In these applications, different types of electric fans may be received within the housing 20.

Referring specifically to FIG. 5, the engine cooling system 100 is shown to include the duct 30 installed within the housing 20 which is mounted to the IC engine 10. FIG. 5 illustrates a positioning of the duct 30, and therefore a potential positioning of the electric fan 40, over a cylinder of the IC engine 10. By positioning the duct 30 and/or the electric fan 40 over the cylinder of the IC engine 10, enhanced cooling capabilities can be provided by the engine cooling system 100 to the IC engine 10. In many applications, the cylinder of the IC engine 10 may produce a large amount of heat energy which may build up within the cylinder or the IC engine 10 in general. Forcing fluid flow (i.e., air flow) over the cylinder causes a portion of the heat energy produced by the cylinder to be diverted away from the cylinder, thereby cooling the cylinder. While the shape of duct 30 is illustrated to be circular, according to various exemplary embodiments, it is understood that the shape of duct 30 may be square, octagonal, hexagonal, triangular, or any other suitable shape depending on the desired application. The ducts 30 are also shown in FIG. 5 to include a number of cut-outs 45. The cut-outs 45 are intended to further direct fluid-flow to a cylinder of the IC engine 10 or the IC engine 10 in general. By including cut-outs 45, the duct 30 may provide proper clearances for specific protrusions (e.g., protuberances, fins, tubes, fixtures, etc.) on the IC engine 10. For example, the cut-outs 45 may be configured to provide a specified clearance from a wiring harness of the IC engine 10. The housing 20 may be configured to attach to various IC engines including different models and versions of the V-twin engine. For example, the housing 20 may be configured to attach to the 993 cubic-centimeter (cc) Briggs & Stratton Vanguard V-twin overhead valve (OHV) horizontal engine, the 803 cc Briggs & Stratton Professional Series V-twin engine, or the 570 cc Briggs & Stratton Commercial Grade Vanguard V-twin engine. In order to maximize the potential of the electric fan engine cooling system, the locations of the openings in the housing 20 may be placed at any suitable location on the housing 20.

Referring to FIGS. 6-10, in some embodiments, it may desirable to induce fluid flow over a large portion of the IC engine 10. An engine cooling system 200 may include an electric fan 210, a first shroud 250, a second shroud 260, a number of studs 290, a number of spacers 270, and a number of nuts 280. According to this embodiment, the electric fan 210 may be configured to generate the fluid flow through the first shroud 250 and second shroud 260 directly to the internal combustion engine 10. According to an exemplary embodiment, the electric fan 210 includes an outer profile 215 and retaining features 212. According to various embodiments, the first shroud 250 is configured to have an inner profile 255 and retaining features 262. According to various embodiments, the second shroud 260 is configured to have retaining features 262, an inner profile 265, and an outer profile 267.

Engine cooling system 200 may be utilized with a variety of air-cooled engine applications. For example, engine cooling system 200 may be utilized in a standby generator or outdoor power equipment. Outdoor power equipment includes lawn mowers, riding tractors, snow throwers, pressure washers, portable generators (e.g., portable genset, etc.), tillers, log splitters, zero-turn radius (ZTR) mowers, walk-behind mowers, riding mowers, industrial vehicles such as forklifts, utility vehicles, etc. Outdoor power equipment may, for example, drive an implement, such as a rotary blade of a lawn mower, a pump of a pressure washer, the auger of a snowthrower, the alternator of a generator, and/or a drivetrain of the outdoor power equipment.

The retaining features 212 of the electric fan 210 may be tabs, hooks, posts, or other suitable retaining mechanisms. The retaining features 212 of the electric fan 210 may be configured to interact with the retaining features 262 of the second shroud 260 or the retaining features 252 of the first shroud 250. According to an exemplary embodiment, retaining features 212 of the electric fan 210 are configured to directly interact with the retaining features 252 of the first shroud 250. In some embodiments, the outer profile 215 of the electric fan 210 is substantially circular in shape. However, the outer profile 215 of the electric fan 210 may be of any suitable shape, size, or configuration. For example, the outer profile 215 of the electric fan 210 may, in one embodiment, may be substantially square shaped.

The second shroud 260 may be configured to accept the electric fan 210 and may be further configured to attach to the first shroud 250. The retaining features 262 of the second shroud 260 may be configured to interact with the retaining features 212 of the electric fan 210 and/or the retaining features 252 of the first shroud 250. The retaining features 262 of the second shroud 260 may be tabs, hooks, posts, or other suitable retaining mechanisms. According to an exemplary embodiment, the retaining features 262 of the second shroud 260 may be a plurality of mounting brackets which may allow the electric fan 210 to be secured to the second shroud 260. According to the shape, size and configuration of the electric fan 210, the inner profile 265 of the second shroud 260 may be of differing configurations necessary to accept the outer profile 215 of the electric fan 210. For example, in an embodiment where the electric fan 210 is substantially square in shape, the inner profile 265 of the second shroud 260 may be configured to have a substantially square opening configured to receive the outer profile 215 of the electric fan 210.

In various embodiments, the inner profile 255 of the first shroud 250 is configured to match the outer profile 267 of the second shroud 260. According to the shape, size and configuration of the second shroud 260, the inner profile 255 of the first shroud 250 may be of differing configurations necessary to accept the outer profile 267 of the second shroud 260. In one embodiment, the inner profile 255 of the first shroud 250 is configured to accept the outer profile 267 of the second shroud 260 which is substantially circular in shape. According to various embodiments, the inner profile 255 of the first shroud 250 is configured to accept the outer profile 215 of the electric fan 210 directly, and the second shroud 260 is not included in the engine cooling system 200. In some embodiments, certain gaps between the inner profile 255 of the first shroud 250 and the outer profile 267 of the second shroud 260 may be included. The retaining features 252 of the first shroud 250 may be configured to interact with the retaining features 212 of the electric fan 210 and/or the retaining features 262 of the second shroud 260. The retaining features 252 of the first shroud 250 may be tabs, hooks, posts, or other suitable retaining mechanisms. According to an exemplary embodiment, retaining features 252 of the first shroud 250 are configured to directly interact with the retaining features 212 of the electric fan 210. The first shroud 250 may be configured to be attached to the internal combustion engine 10 and to the second shroud 260 through the use of the spacers 270, the nuts 280, and the studs 290. According to various embodiments, the studs 290 may be integrated within the IC engine 10. According to an exemplary embodiment, the electric fan 210 is configured to be a 30.48 centimeter (12 inch) circular fan that is configured to run off of 12V DC and draw approximately 6.5 A.

According to the embodiments shown in FIGS. 6-10, the need for a relatively longer duct is eliminated and air may be permitted to flow directly onto a target location. According to various embodiments, the electric fan 210 is powered via a hub motor. In these embodiments, the hub motor may be positioned concentric with the electric fan 210 and configured to provide direct power transmission to the electric fan 210 (i.e., through the use of a coupler, through the fan being mounted directly to the output shaft of the hub motor, etc.). In another embodiment, the electric fan may be of the centrifugal (e.g., squirrel-cage, blower, etc.) fan type. In this embodiment, the electric fan 210 may be mounted such that the outlet of the electric fan 210 corresponds with an opening 212 in the first shroud 250. In this embodiment, the second shroud 260 and/or first shroud 250 may need to be further configured to mount the electric fan 210. For example, either the first shroud 250 or the second shroud 260 may need to include a mounting bracket allowing the centrifugal fan to be positioned in the proper orientation (e.g., such that the outlet is proximate the opening 212 in the first shroud 250).

According to various embodiments, the electric fan may be configured to be a brushless permanent magnet DC motor, DC motor, AC motor, direct-drive motor, or other high efficiency motor. According to various embodiments, the studs 290, the nuts 280, and the spacers 270 may alone or in combination secure the second shroud 260 (thereby including the electric fan) to the IC engine 10. In application, the studs 290 may protrude through the first shroud 250 and through the second shroud 260. In between the second shroud 260 and first shroud 250 a spacer 270 may be placed. In order to secure the second shroud 260 and first shroud 250 to the internal combustion engine 10, the nut 280 may be threaded onto the stud 290. This process may be repeated for multiple studs 290 in order to fully secure the assembly. According to various embodiments, in order to attach the electric fan 210 to the second shroud 260, the retaining features 212 of the electric fan 210 may include several radial protrusions which may be snap fitted into the retaining features 262 of the second shroud 260 which may include several corresponding recesses within the second shroud 260. According to one embodiment, the electric fan may be the VA10-AP9/C-25A electric fan produced by SPAL Automotive.

According to another embodiment, the electric fan is be configured to operate off of 120V AC from an application site in order to operate in the most desirable manner. According to yet another embodiment, the electric fan is be configured to operate off of 120V AC produced by the standby generator. The utilization of electric fans 40, similar to typical water-cooled radiator fans, allows for a substantial portion of the internal combustion engine 10 to be cooled by a single device.

Figure 11:
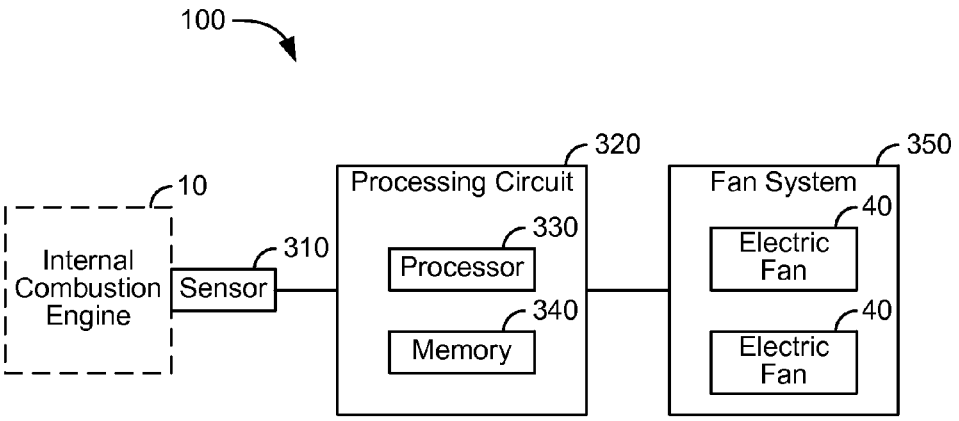
FIG. 11 is a diagram of a control system for an engine cooling system, according to an exemplary embodiment of the present disclosure.
Figure 12:
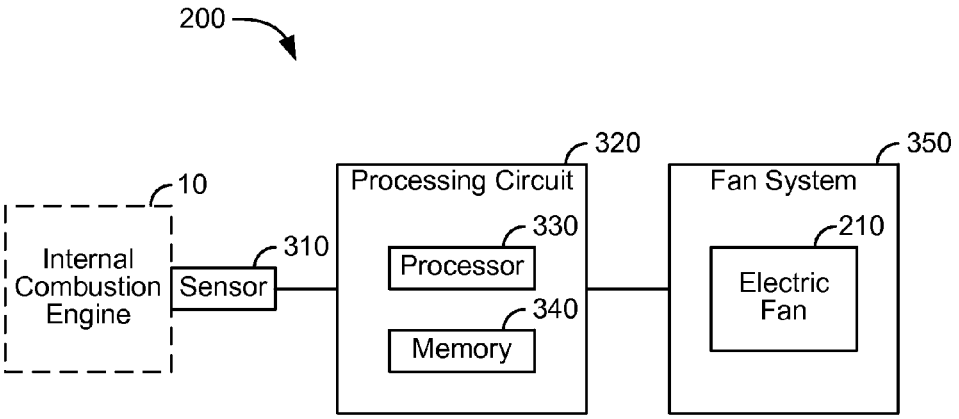
FIG. 12 is a diagram of a control system for an engine cooling system, according to another exemplary embodiment of the present disclosure.

Referring now to FIGS. 11-12, various control diagrams for the engine cooling system 100 and the engine cooling system 200 are shown, according to various exemplary embodiments. FIG. 11 illustrates the control diagram for the engine cooling system 100 which includes, according to an exemplary embodiment, a number of sensors 310 mounted to or around the IC engine 10, a processing circuit 320, which includes a processor 330 and a memory 340, and a fan system 350, shown to include a number of the electric fans 40. According to an exemplary embodiment, the sensors 310 communicate various data to the processing circuit 320 to determine an appropriate response of the fan system 350 according to instructions stored in the memory 340 of the processing circuit 320. In one embodiment, the memory 340 of the processing circuit 320 is configured to include thresholds for data obtained from the sensors 310. According to another exemplary embodiment, the memory 340 of the processing circuit 310 includes thresholds on the fluctuations of data (e.g., the rate of change of the data) obtained from the sensors 310. The memory 340 of the processing circuit may include any suitable comparison data, instruction, or other information for a given application. The sensors 310 may measure temperature, chemical composition of exhaust gases, local humidity, vibrational energy or oscillations, electrical conductivity, and other suitable properties. Processing circuit 320 may be a thermo-mechanical relay that powers engine cooling system 100 and/or engine cooling system 200 once a target temperature has been reached.

In FIGS. 11-12, the sensors 310 are shown to generally attach to the IC engine 10, but may be attached to various specific locations of the IC engine 10 or other components. For example, the sensors 310 may be attached to the engine block, cylinder head, crank shaft, cylinder, cam shaft, valve cover, or other suitable location on the IC engine 10. The sensors 310 may measure operating speed of the IC engine 10, rotations of the crank shaft of the IC engine 10, rotations of the cam shaft of the IC engine 10, operating time of the IC engine 10, ambient temperature, oil temperature of the IC engine 10, oil pressure of the IC engine 10, air-to-fuel ratio of the IC engine 10, mass air flow of the IC engine 10, mass air pressure of the IC engine 10, and other suitable measurements of the IC engine 10. According to an exemplary embodiment, the sensors 310 are configured to measure the temperature of the cylinder head of the IC engine 10. Still according to this embodiment, the sensors 310 relay data to the processing circuit 320 which compares the data relayed from the sensors 310 to data stored in the memory 340 and provides instructions to the fan system 350 according to this comparison. For example, the sensors 310 may determine that the temperature of the IC engine 10 is above a desired threshold. The processing circuit may then instruct the fan system to power the electric fans 40 in order to reduce the temperature of the IC engine 10. The fan system 350 may include any combination of the electric fan 40, the electric fan 210, and/or any other suitable fan. As shown in FIG. 11, the fan system 350 may include two electric fans 40. In other embodiments, the fan system 350 may include one, three, or more electric fans 40. As shown in FIG. 12, the fan system 350 may include one electric fan 210. In other embodiments, the fan system 350 may include two, three, or more electric fans 210.

According to various embodiments, sensors 310 may be thermocouples, air flow meters, flow sensors, mass air flow sensors, rotary encoders, tachometers, hall effect sensors, speedometers, manifold absolute pressure sensors, oxygen sensors, speed sensors, throttle position sensors, torque sensors, variable reluctance sensors, vehicle speed sensors, and other suitable sensors. Sensors 310 may also be ambient sensors located on or near the outside of the standby generator intended to provide ambient temperature or other readings. The processing circuit may be configured to receive readings from the internal combustion engine sensors and/or ambient sensors and determine, among other calculations, an appropriate operation manner for the electric cooling system. For example, during exercise cycles in certain ambient temperatures, such as temperatures below 15 degrees Celsius (59 degrees Fahrenheit), the engine cooling system 100 may not turn on because it is not needed. In this example, the noise pollution of the standby generator would be decreased and the fuel efficiency of the standby generator increased because the electric fan cooling was not required to run, or ran for a substantially shorter amount of time. In other examples, the electric cooling fan system may periodically turn on and turn off, depending on the cooling needs of the standby generator.

According to an exemplary embodiment, sensors 310 are mounted to the engine block and are configured to monitor the temperature of the engine block of the IC engine 10. According to this embodiment, the memory 340 includes a threshold of one-hundred and twenty degrees Celsius. In application, according to this exemplary embodiment, the processing circuit 320 will instruct the fan system 350 to increase output when the temperature measured by the sensors 310 of the engine block exceeds the threshold stored in the memory 340 of one-hundred and twenty degrees Celsius. According to another exemplary embodiment, sensors 310 are mounted to the cylinder head and are configured to monitor the temperature of the cylinder head of the IC engine 10. According to this embodiment, the memory 340 includes a threshold of one-hundred and thirty degrees Celsius. In application, according to this exemplary embodiment, the processing circuit 320 will instruct the fan system 350 to increase output when the temperature measured by the sensors 310 of the cylinder heads exceeds the threshold stored in the memory 340 of one-hundred and thirty degrees Celsius. According to another exemplary embodiment, sensors 310 are mounted within or proximate the oil cooler and are configured to monitor the temperature of oil within the oil cooler of the IC engine 10. According to this embodiment, the memory 340 includes a threshold of one-hundred and ten degrees Celsius. In application, according to this exemplary embodiment, the processing circuit 320 will instruct the fan system 350 to increase output when the temperature measured by the sensors 310 of the oil within the oil cooler exceeds the threshold stored in the memory 340 of one-hundred and ten degrees Celsius.

An issue that plagues typical internal combustion engines with fans mechanically coupled to their crankshafts, such as traditional standby generators, is a condition called a hot soak. A hot soak occurs when the internal combustion engine has built up a sufficient amount of internal heat energy within the engine block and associated components and is subsequently shut off. On a traditional standby generator, once the internal combustion engine is shut off, the fan stops cooling the engine. During the hot soak, the internal combustion engine within the traditional standby generator continues to build up heat energy within the engine block and associated components, but there is no longer a cooling force acting on the internal combustion engine. As a result, the internal combustion engine may reach temperatures greater than the highest operating temperature, and may stay at these elevated temperatures for a prolonged period of time. Hot soaking, as seen, for example, in traditional standby generators, may lead to increased component degradation and ultimately to premature failure of the standby generator. Through the utilization of the engine cooling system 100 or engine cooling system 200, the electric fans 40 or the electric fans 210, respectively, may be operated after the IC engine 10 has been shut off, through the use of a capacitor or battery system, or through an application site power grid. In this manner, the electric cooling system may prolong component life and thereby the useful life of the standby generator it is installed in. According to various embodiments, the electric cooling system may be implemented in both an HSB generator and/or a commercial standby generator. According to various embodiments, the housing 20, ducts 30, electric fans 40, first shroud 250, the spacer 70, the nut 80, the stud 90, and the shroud may be constructed from heat resistant materials such as thermal resistant plastics, thermosetting polymer blends, metallic alloys, metals, and materials suitable for prolonged exposure to the typical operating temperatures of an internal combustion engine.

In other embodiments, the engine cooling system 100 and/or the engine cooling system 200 may be implemented for use on outdoor power equipment such as riding lawn mowers, zero-turn radius (ZTR) lawn mowers, mowers, tractors, excavators, backhoes, forklifts, etc. By incorporating an engine cooling system 100 and/or engine cooling system 200, the outdoor power equipment may be variably cooled to more closely match cooling output with cooling demands.

At least one of the various controllers described herein may be implemented as a general-purpose processor, an application specific integrated circuit (ASIC), one or more field programmable gate arrays (FPGAs), a digital-signal-processor (DSP), a group of processing components, or other suitable electronic processing components. In one embodiment, at least one of the controllers includes memory and a processor. The memory is one or more devices (e.g., RAM, ROM, Flash Memory, hard disk storage, etc.) for storing data and/or computer code for facilitating the various processes described herein. The memory may be or include non-transient volatile memory or non-volatile memory. The memory may include database components, object code components, script components, or any type of information structure for supporting the various activities and information structures described herein. The memory may be communicably connected to the processor and provide computer code or instructions to the processor for executing the processes described herein. The processor may be implemented as a general-purpose processor, an application specific integrated circuit (ASIC), one or more field programmable gate arrays (FPGAs), a digital-signal-processor (DSP), a group of processing components, or other suitable electronic processing components.

It is important to note that the construction and arrangement of the elements of the systems and methods as shown in the embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. By way of example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations. The order or sequence of any process or method steps may be varied or re-sequenced, according to alternative embodiments. Other substitutions, modifications, changes, and omissions may be made in the design, operating conditions, and arrangement of the preferred and other embodiments without departing from scope of the present disclosure.

The present disclosure contemplates methods, systems, and program products on any machine-readable media for accomplishing various operations. Some of the embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, by way of example, instructions and data, which cause a general-purpose computer, special purpose computer, or special purpose processing machines to perform a certain function or group of functions.

The various control systems and circuits described herein (including in the related applications incorporated by reference) may be implemented as "non-programmable circuitry" that consists of analog or digital hard circuitry that does not utilize a microcontroller or software or as a controller, microcontroller, computer, or other programmable device. It is believed that embodiments in which the controls are implemented as non-programmable circuitry including discrete components may be less expensive than embodiments implemented with microcontrollers or using software. Such non-programmable circuitry embodiments do not include a microcontroller. An example of such non-programmable circuitry is a relay such as a thermo-mechanical relay.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

The invention claimed is:

1. A cooling system for an air-cooled engine for use with a standby generator, the cooling system comprising:

an air-cooled engine;

an alternator coupled to and driven by the air-cooled engine;

a plurality of electric fans;

a plurality of ducts, each duct configured to receive one of the plurality of electric fans;

a housing configured to be coupled to the air-cooled engine and including at least one opening, each opening configured to receive one of the plurality of ducts to direct air from the electric fans to a plurality of target locations;

a sensor configured to acquire sensor data regarding operation of the air-cooled engine;

an ambient sensor configured to monitor ambient temperature; and a processing circuit configured to receive the sensor data from the sensor and to control operation of the plurality of electric fans in accordance with the sensor data;

wherein the processing circuit is configured to maintain the plurality of electric fans in an off condition upon starting of the air-cooled engine in response to receiving a sensed ambient temperature below an ambient temperature threshold from the ambient sensor.

2. The cooling system of claim 1, wherein the processing circuit is configured to control operation of the plurality of electric fans independent from an operating speed of the engine.

3. The cooling system of claim 1, wherein the sensor is configured to monitor at least one of engine speed, engine temperature, ambient temperature, cylinder temperature, cylinder head temperature, and oil cooler temperature.

4. The cooling system of claim 1, wherein the plurality of target locations includes at least one of a cylinder, a cylinder head, an oil cooler, and an alternator.

5. The cooling system of claim 1, further comprising a mounting bracket and wherein one of the plurality of ducts is configured to securely attach to the mounting bracket.

6. The cooling system of claim 5, wherein the mounting bracket is configured to position one of the plurality of electric fans over at least one of a cylinder, a cylinder head, an oil cooler, and an alternator.

7. The cooling system of claim 1, wherein the processing circuit is configured to continuously vary the output of the electric fans to achieve a desired parameter.

8. The cooling system of claim 1, wherein the processing circuit is configured to modulate the output of the electric fans according to a modulation scheme and wherein the modulation scheme is one of pulse-width modulation and pulse-duration modulation.

9. The cooling system of claim 1, wherein the processing circuit is at least one of a general-purpose processor and non-programmable circuitry.

10. A cooling system for an air-cooled engine, the cooling system comprising:

an electric fan;

a shroud assembly;

a sensor configured to acquire sensor data regarding operation of the engine;

an ambient sensor configured to monitor ambient temperature; and a processing circuit;

wherein the processing circuit is configured to receive the sensor data from the sensor to determine a cooling need for the engine and to vary the cooling output of the electric fan in accordance with the cooling need;

wherein the processing circuit is configured to maintain the electric fan in an off condition upon starting of the engine in response to receiving a sensed ambient temperature below an ambient temperature threshold from the ambient sensor.

11. The cooling system of claim 10, wherein the shroud assembly comprises:

a first shroud configured to securely attach to the engine; and a second shroud configured to securely receive the electric fan and to securely attach to the first shroud.

12. The cooling system of claim 10, wherein the sensor is configured to monitor at least one of engine speed, engine temperature, ambient temperature, cylinder temperature, cylinder head temperature, and oil cooler temperature.

13. The cooling system of claim 10, further comprising a mounting bracket and an electric fan;

wherein the mounting bracket is configured to position the electric fan over at least one of a cylinder, a cylinder head, an oil cooler, and an alternator.

14. The cooling system of claim 10, wherein the processing circuit is configured to modulate the output of the electric fan to achieve a desired parameter.

15. The cooling system of claim 10, wherein the processing circuit is configured to modulate the output of the electric fan according to a modulation scheme and wherein the modulation scheme is one of pulse-width modulation and pulse-duration modulation.

16. The cooling system of claim 10, wherein the processing circuit is at least one of a general-purpose processor and non-programmable circuitry.

17. A control system for an engine cooling system, comprising:

a sensor configured to acquire sensor data regarding operation of an engine;

an ambient sensor configured to monitor ambient temperature; and a processing circuit configured to:

receive the sensor data;

determine a cooling need of the engine based on the sensor data;

control operation of at least one electric fan independent from an operating speed of the engine and based on the cooling need of the engine; and maintain the at least one electric fan in an off condition upon starting of the engine in response to receiving a sensed ambient temperature below an ambient temperature threshold from the ambient sensor.

18. The control system of claim 17, wherein the sensor is configured to monitor at least one of engine speed, engine temperature, ambient temperature, cylinder temperature, cylinder head temperature, and oil cooler temperature.

* * * * *